United States Patent [19]

Hertel

[11] Patent Number: 4,821,613

[45] Date of Patent: Apr. 18, 1989

[54] METHOD AND APPARATUS FOR LOG SAW BLADE SHARPENING

[75] Inventor: James E. Hertel, Green Bay, Wis.

[73] Assignee: Paper Converting Machine Company, Green Bay, Wis.

[21] Appl. No.: 64,136

[22] Filed: Jun. 19, 1987

[51] Int. Cl.[4] ..... B26D 7/12

[52] U.S. Cl. ..... 83/13; 51/247; 83/174

[58] Field of Search ..... 83/13, 174, 174.1; 51/246, 247, 285; 76/85, 89, 82

[56] References Cited

U.S. PATENT DOCUMENTS

| | | | |
|---|---|---|---|
| 3,213,731 | 10/1965 | Renard | 83/174 |
| 4,347,771 | 9/1982 | Bradley | 83/174 |
| 4,584,917 | 4/1986 | Blom | 83/174 |

*Primary Examiner*—Frank T. Yost
*Assistant Examiner*—Hien H. Phan
*Attorney, Agent, or Firm*—Tilton, Fallon, Lungmus & Chestnut

[57] ABSTRACT

A modified grinding process for smooth circular saw blades whereby the blade rate of rotation is constantly varied to avoid the system natural frequencies and improve the resulting saw surface edge.

4 Claims, 2 Drawing Sheets

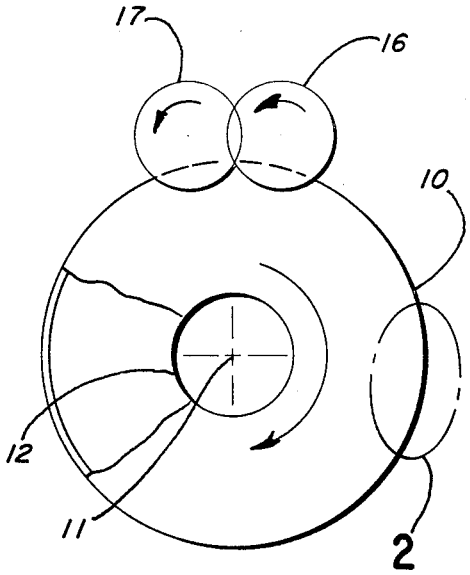
FIG. 1
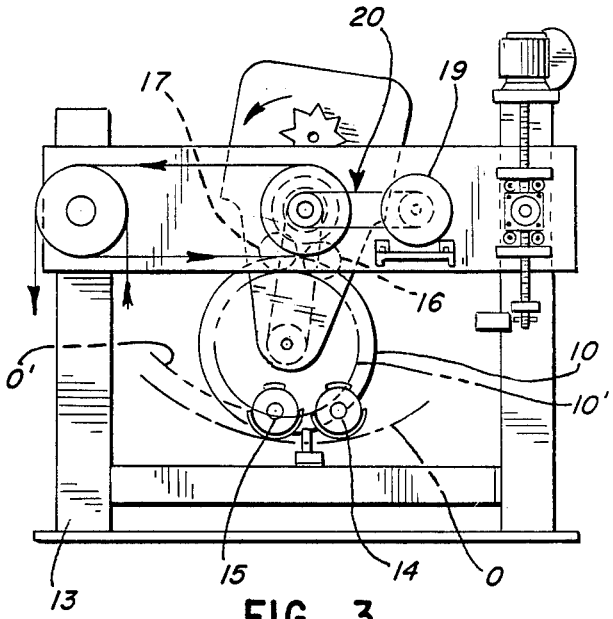
FIG. 3
FIG. 2
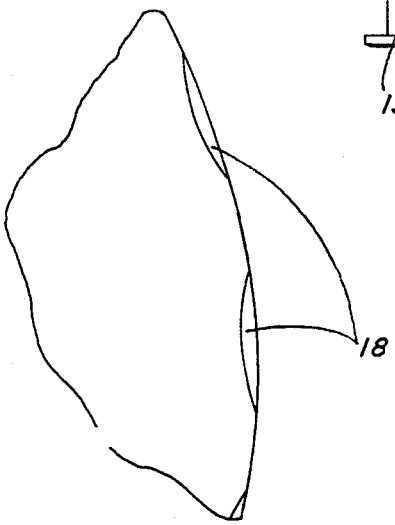
FIG. 4A
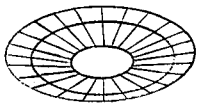
FIG. 5A
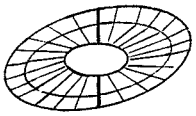
FIG. 6A
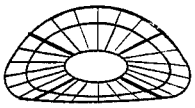
FIG. 7A
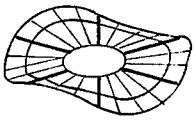
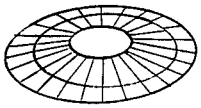
FIG. 4B
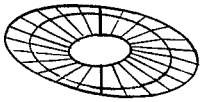
FIG. 5B
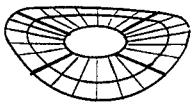
FIG. 6B
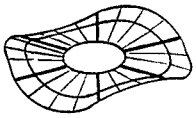
FIG. 7B

METHOD AND APPARATUS FOR LOG SAW BLADE SHARPENING

BACKGROUND AND SUMMARY OF INVENTION

This invention relates to a method and apparatus for log saw blade sharpening and, more particularly, to a method and apparatus which if not substantially eliminates, substantially maximizes the defect of "scalloping" characteristic of the prior art sharpeners.

The log saws to which this invention applies are widely used in conjunction with the rewinding of paper webs to develop toilet tissue and toweling. Rewinding is a well-known and long used procedure—antedating this century. A jumbo roll of paper from the paper-making machine is unwound, usually transversely perforated, and then rewound into a product having the retail size roll diameter. Until the 1950's, the web was slit longitudinally in the rewinder so as to develop the individual rolls of product. For example, in the United States, toilet tissue rolls are normally 4½" wide, i.e., in the axial length. Thus, the slitters on a rewinder developing toilet tissue would slit the unwound web into 4½" wide ribbons. These then were wound or "rewound" on paper cores cut to the same length and the product only needed to be packaged for being in the form for offering to the consumer.

Several significant defects attended this early process. For example, the narrow ribbons would often overwind one another or interweave causing the separate rolls to be firmly lockd together after winding. In other cases, the individual narrow webs were more likely to break, thus causing more frequent stoppages and low winder efficiency.

In the 1950's, the first log saws became available so that it was no longer necessary to slit the web on the rewinder but the entire web could be wound into a log containing a plurality of ultimate consumer rolls. For example, it is not uncommon for a web to be in excess of 100" wide which then results in the provision of more than 20 retail size rolls of toilet tissue. The log saws operated to transversely sever the wound log into retail size lengths, viz., normally 4½" of axial length for toilet tissue and 11" axial length for kitchen toweling.

Over the years of use of log was which uniformly made use of rotating disc blades, there has been a continuing problem of sharpening. It will be appreciated that the saw disc has to remain sharp to make a clean, square cut. If this does not occur, the product is inferior and can be rejected either by the manufacturer or the customer. Thus, there have been many approaches to maintaining the blade disc in sharpened condition.

These efforts have been frustrated because of the phenomenon of scalloping.

Scalloping refers to the condition of the blade edge whereby the grinding is uneven causing an out-of-round condition. Usually the deviation from round consists of many (any where from 6 to 40) evenly spaced depressions in the blade circumference. Once the scalloping pattern is established, it will typically compound in severity. As a consequence, the disc blade very quickly is placed out of service due to poor cutting quality an violent grinding action.

One approach attempting to relieve the scalloping problem is set forth in co-owned U.S. Pat. No. 4,347,771. This has not proven to be as effective as originally contemplated and therefore the scalloping problem persisted.

Many causes of blade scalloping have been proposed. It is suggested that this is due to vibration. The saw blade can be considered as a rotating disc which, depending upon its geometry (diameter, thickness, clamp collar diameter, taper, etc.) and material, has multiple modes or frequencies of vibration. At these frequencies, the blade will easily sustain vibration if excited by an external force which has some component of the same frequency in its spectrum.

The dynamics of rotating blades have been studied both theoretically and empirically (see Lamb and Southwall "Vibrations of a Spinning Disk", Proceedings of the Royal Society 1921). For example, a 24" diameter steel saw blade, 0.095" thick with a 6" diameter collar can be calculated to have a multiplicity of modes of vibration, according to Schajer "Simple Formulas for Natural Frequencies and Critical Speeds of Circular Saws", Forest Product Journal, Volume 36, No. 2, 1986. This calculation leads to the determination of the 24" diameter steel saw blade having zero Nodal Diameters at 37 herz, 1 Nodal Diameter at 35 herz, 2 Nodal Diameters at 45 herz, 3 Nodal Diameters at 83 herz, 4 Nodal Diameters at 143 herz, 5 Nodal Diameters at 218 herz and 6 Nodal Diameters at 308 herz.

During sharpening, the blade and grindstone dynamics are excited by small disturbances such as initially out-of-round blade or initial stone-blade contact to product a spectrum of grinding forces. Because the amount of blade material removed is related to grind force, a slightly irregular surface is formed by these variable forces. Then, due to the rotation of the blade, the surface is continuously recycled past the grinder so that the frequencies corresponding to the saw/grinder natural frequencies are selectively accentuated. The surface frequency which best agrees with one of the blade-stone frequencies will be the first to develop a scalloped pattern.

For example, a blade rotating at 770 rpm with 17 scallops on the circumference produces a surface frequency of 218 hertz which coincides with the fifth mode of vibration.

PROBLEM STATEMENT

The saw blades, grinding stones and supporting mechanisms are very complex structures, and, as such, have a very crowded spectrum of natural frequencies, In addition, harmonics or multiples of the saw surface frequencies will also excite the blade/stone frequencies making the possible combinations virtually impossible to predict.

Combining this with the fact that both cutting and sharpening wear the surface of the blade so that over a period of time the blade diameter changes significantly, finding a fixed blade rotational speed to avoid scalloping is very difficult.

Another approach to avoid blade scalloping is to increase the blade stability, i.e., reduce it dynamics. Many techniques have been used to accomplish this such as blade "tensioning", blade taper, collar dampers, etc. However, scalloping continues to be a problem. Reducing the blade diameter or increasing the collar diameter would greatly increase the blade stability but this also greatly limits the usable cutting area of the blade and hence reduces its useful life.

THE INVENTION

By varying the speed of the saw blade it is possible to shift the frequency spectrum produced by the blade surface. If the blade speed according to the preferred embodiment is steadily increased to a maximum operating speed and then immediately decelerated to some minimum operated speed and this periodically reproduced, possible scalloping frequencies are forced to change so that a scalloping pattern from one frequency is corrupted, i.e., cancelled out by a scalloping pattern from another frequency. In this manner, the blade surface is prevented from developing a single scalloping frequency and the blade/stone dynamics are more evenly excited.

The invention will be explained in conjunction with the accompanying drawing, in which FIG. 1 is a schematic end elevational view of a typical log saw equipped with sharpening stones;

FIG. 2 is an enlarged fragmentary end elevational view of the portion generally encircled in FIG. 1;

FIG. 3 is an end elevational view of a log saw suitable for practicing the instant invention; and FIGS. 4A and 4B are perspective views of a disc having zero nodal diameters as referred to previously, i.e., at 37 Hz;

FIGS. 5A and 5B are perspective views of a disc having one nodal diameter, i.e., at 35 Hz;

FIGS. 6A and 6B are perspective views of a disc having two nodal diameters, i.e., at 45 Hz;

FIGS. 7A and 7B are perspective views of a disc having three nodal diameters, i.e., at 83 Hz;

Figure 8:
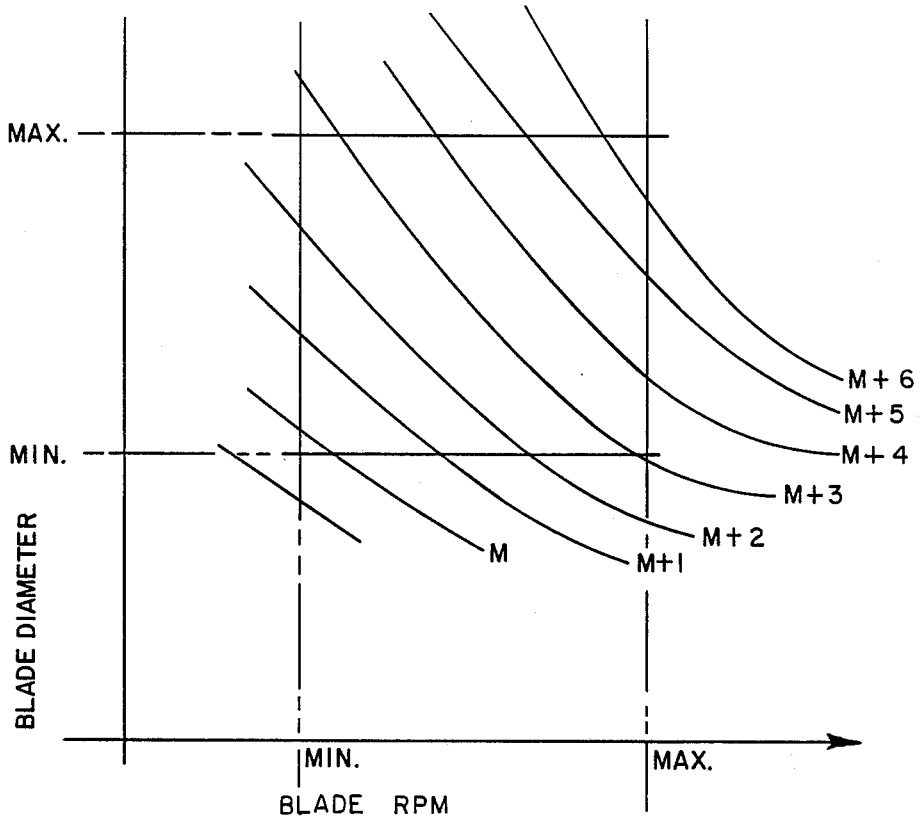
FIG. 8 is a chart of blade natural frequencies, viz., n, n+1, etc. which coincide with blade surface frequencies over the usable range of blade diameter and speed.
Figure 9:
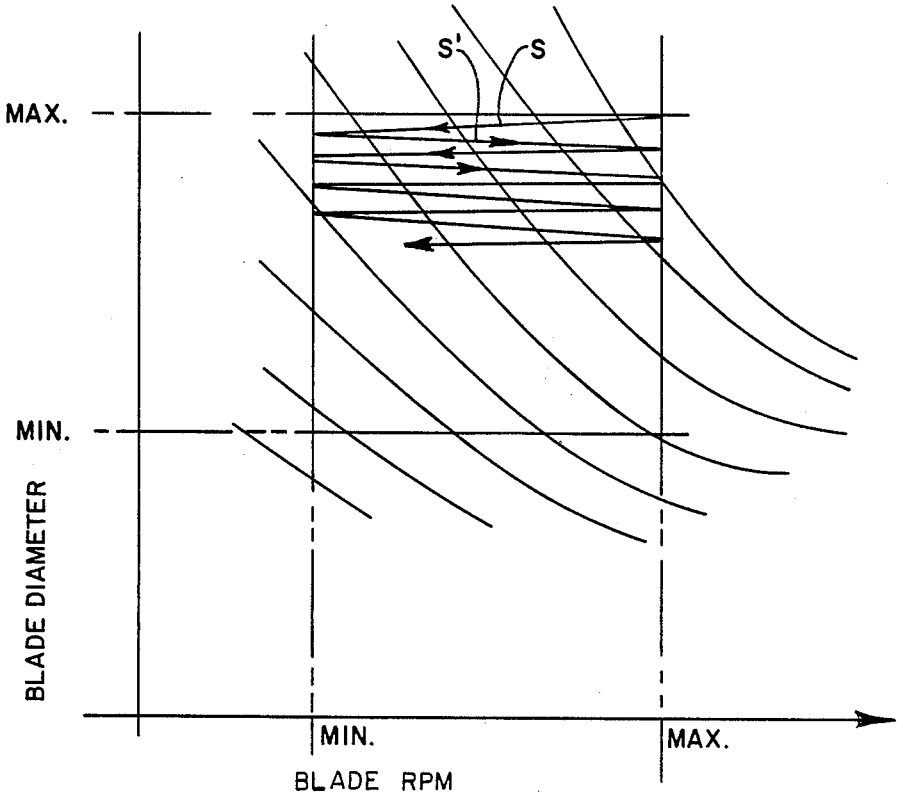
FIG. 9 is the chart of FIG. 8 with an additional plot showing the effect of constantly varying the blade speed as the blade diameter decreases.

In FIG. 1, the numeral 10 designates a saw blade which is mounted for rotation about an axis 11 and being secured to a supporting shaft by means of a clamp collar 12. Such a blade 10 is seen in an operating environment in FIG. 3 which is patterned generally after the showing in co-owned U.S. Pat. No. 4,584,917. The log saw is generally supported by a frame 13 through which logs 14 and 15 pass for transverse severing. The disc blade 10 follows an orbital path designated 0 in FIG. 3 and the logs 14 and 15 are placed near the nadir of the orbital path. The sharpening stones 16 and 17 are arranged to follow the orbital path of the blade 10. As these operate against the disc blade 10—as for example a sequence of three seconds out of a twenty second cycle—the diameter of the saw blade is reduced and thereafter the blade has to be lowered otherwise the orbit would be that designated 0' for a blade having the diameter designated 10' in FIG. 3.

The prior art phenomenon of scalloping is illustrated in FIG. 2 where the scallops are designated at 18. The problem of scalloping has been avoided through the practice of the invention by means of the change in speed of rotation of the disc blade 10. Conventionally, the disc blade 10 is driven from a motor 19 and through a drive generally designated 20.

EXAMPLE

A saw blade was fitted with a grinding system and operate under several sharpening conditions, all of which cause the blade 10 to scallop. Thereafter, the motor 19 and drive 20 were replaced by a variable speed AC drive so that the blade rotation was reduced linearly to 50% of maximum speed in approximately 20 seconds. This cycle was continuously repeated whenever the grinding stones were in contact with the blade 10. At this time, the saw blade was making 180 orbits per minute.

One of the scallop blades from the initial experiments was tested with the variable saw speed and the scalloped edge was corrected with no further evidence of scalloping.

Normally the speed of rotation of a 24" disc blade is of the order of 1500 rpm. Excellent results are obtained by reducing this speed to 750 rpm and then cycling brake up to 1500, continuing the cyclic decreasing and increasing of speed so long as grinding occurs. Not only does this correct scalloping but is productive of the same superior type of log throughout the entire grinding life as has been available only in the beginning stages of the life of a blade.

The 24" diameter blades, because of scalloping, have had to be removed from use after about 1" reduction in diameter, i.e., to about 23". The goal has always been to continue the useful life of a blade until its diameter is of the order of about 18" and this now is possible through the practice of the invention. It is to be appreciated that the converters of web products who utilize rewinders and log saws want to keep repair and maintenance to a minimum, particularly in view of the fact that it costs $300 to $400 for each blade. Blades afflicted by scalloping had to be thrown away over-ground in a special facility—after one day's installation whereas the practice of the invention makes it possible to utilize a single blade for almost a week.

From the example given above, it will be seen that the period of speed change is relatively large in comparison to the orbital speed. In the example given, a cycle of speed decrease and increase took approximately 120 orbits. It will be appreciated that the relationship of the cycle of speed change and the orbital period may vary widely depending upon the dynamics of a particular system.

An illustration of a blade natural frequencies in terms of speed and diameter is presented graphically in FIG. 8 where the blade diameter is the ordinate and the blade speed is the abscissa. In the general central area 21, a "window" is defined between speeds of "MIN" and "MAX" speed and diameters of "MIN" to "MAX". Typical are speeds of 750 to 1500 rpm and diameters of 18" to 24". In that window, it will be seen that there are a number of curves representing the different vibration frequencies that have to be avoided if one is to avoid scalloping. For example, when the blade diameter decreases at constant speed of MAX, shortly the curve n+6 is encountered which results in scalloping. If the scalloping is severe enough, the blade has to be replaced. If not, in short order the blade encounters the curve n+5 where further scalloping occurs, etc.

I claim:

1. In a method of operating an orbiting, rotating disc blade for sawing logs of wound web material, the steps of engaging said blade with a sharpening stone at one portion of an orbit and changing the speed of rotation of said blade to avoid sharpening at the natural frequency of vibration of said blade.

2. A method of eliminating scalloping of an orbiting, rotating disc blade for sawing paper logs comprising rotating said blade, sharpening the blade edge, and alternately increasing and decreasing the speed of rotation of said disc blade.

3. The method of claim 2 in which said speed varies cyclically from the maximum to about one-half the maximum.

4. Apparatus for sawing logs of wound web material comprising a frame, means on said frame for advancing logs along a linear path, means on said frame for moving a rotating disc through an orbital path transverse to said linear path, means adjacent said orbital path for sharpening the edge of said disc, and means for cyclically varying the speed of rotation of said disc.

* * * * *